US009103071B2

(12) United States Patent
Jehn-Rendu

(10) Patent No.: US 9,103,071 B2
(45) Date of Patent: Aug. 11, 2015

(54) MANUFACTURE OF PAPER AND PAPERBOARD

(75) Inventor: Christian Jehn-Rendu, Shanghai (CN)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/125,401

(22) PCT Filed: Jun. 20, 2012

(86) PCT No.: PCT/EP2012/061775

§ 371 (c)(1),
(2), (4) Date: Dec. 11, 2013

(87) PCT Pub. No.: WO2012/175528

PCT Pub. Date: Dec. 27, 2012

(65) Prior Publication Data

US 2014/0124155 A1 May 8, 2014

(30) Foreign Application Priority Data

Jun. 20, 2011 (WO) ..... PCT/CN2011/075933
Jun. 22, 2011 (WO) ..... PCT/CN2011/076131

(51) Int. Cl.
*D21H 21/10* (2006.01)
*D21H 17/37* (2006.01)
*D21H 17/44* (2006.01)

(52) U.S. Cl.
CPC ..... *D21H 17/37* (2013.01); *D21H 17/44* (2013.01); *D21H 21/10* (2013.01)

(58) Field of Classification Search
CPC ..... D21H 21/10; D21H 17/375; D21H 17/44; D21H 23/14; D21H 17/45; D21H 17/55; D21H 17/56; D21H 17/63; D21H 23/04; D21H 17/37
USPC ..... 162/158, 164.1, 164.6, 168.1–168.3, 162/183–185, 181.1–181.9
See application file for complete search history.

(56) References Cited

U.S. PATENT DOCUMENTS 3,215,654 A * 11/1965 Schmalz ..... 524/843
4,144,123 A * 3/1979 Scharf et al. ..... 162/164.3
4,988,790 A 1/1991 Behn et al.
5,178,730 A * 1/1993 Bixler et al. ..... 162/168.3
5,266,164 A * 11/1993 Novak et al. ..... 162/168.2
5,571,380 A * 11/1996 Fallon ..... 162/168.2
5,876,563 A * 3/1999 Greenwood ..... 162/175
5,958,188 A 9/1999 Heard et al.
6,103,065 A * 8/2000 Humphreys et al. ..... 162/181.8
6,132,558 A 10/2000 Dyllick-Brenzinger et al.
6,238,520 B1 * 5/2001 Greenwood ..... 162/164.1
6,310,157 B1 10/2001 Heard et al.
7,883,603 B2 * 2/2011 Hund et al. ..... 162/164.6
7,955,473 B2 * 6/2011 Solhage et al. ..... 162/168.3
8,101,046 B2 * 1/2012 Goto et al. ..... 162/164.6
8,308,903 B2 * 11/2012 Solhage et al. ..... 162/168.3
8,597,467 B2 * 12/2013 Jehn-Rendu et al. ..... 162/164.6
8,790,493 B2 * 7/2014 Solhage et al. ..... 162/168.3
8,916,026 B2 * 12/2014 Jehn-Rendu et al. ..... 162/158
2002/0066540 A1 * 6/2002 Chen et al. ..... 162/17
2005/0150622 A1 * 7/2005 Hund et al. ..... 162/181.8
2006/0130991 A1 * 6/2006 Solhage et al. ..... 162/158
2006/0243407 A1 * 11/2006 Hund et al. ..... 162/158
2007/0187330 A1 8/2007 Whittaker et al.
2009/0025891 A1 * 1/2009 Wong Shing et al. ..... 162/5
2009/0065162 A1 3/2009 Cheng et al.
2009/0267258 A1 10/2009 Cheng et al.
2009/0277597 A1 11/2009 Hund et al.
2009/0283232 A1 * 11/2009 Hund et al. ..... 162/164.6
2010/0147475 A1 * 6/2010 Koch et al. ..... 162/164.6
2010/0186914 A1 * 7/2010 Jehn-Rendu et al. ..... 162/164.6
2011/0132559 A1 * 6/2011 Haehnle et al. ..... 162/164.6
2011/0155339 A1 * 6/2011 Brungardt et al. ..... 162/164.6
2011/0247773 A1 * 10/2011 Solhage et al. ..... 162/164.4
2012/0073773 A1 * 3/2012 Jehn-Rendu et al. ..... 162/164.5
2012/0216970 A9 * 8/2012 Wong Shing et al. ..... 162/5
2013/0274369 A1 * 10/2013 Millard et al. ..... 522/175
2013/0277002 A1 * 10/2013 Solhage et al. ..... 162/164.4

(Continued)

FOREIGN PATENT DOCUMENTS

CN 1930092 A 3/2007
CN 101068985 A 11/2007

(Continued)

OTHER PUBLICATIONS

International Search Report and Written Opinion issued Mar. 22, 2012 in PCT/CN2011/075933 filed Jun. 20, 2011.
International Search Report and Written Opinion issued May 17, 2012 PCT/CN2011/076131 filed Jun. 22, 2011.
International Search Report and Written Opinion issued Aug. 10, 2012 in PCT/EP2012/061775 filed Jun. 20, 2012.
International Search Report issued Aug. 10, 2012 in Application No. PCT/EP2012/061775.
International Preliminary Report on Patentability and Written Opinion issued Jan. 9, 2014 in Application No. PCT/EP2012/061775.
U.S. Appl. No. 14/373,174, filed Jul. 18, 2014, Gray, et al.

*Primary Examiner* — Jose Fortuna
(74) *Attorney, Agent, or Firm* — Oblon, McClelland, Maier & Neustadt, L.L.P.

(57) ABSTRACT

The present invention relates to a process of making paper or paperboard, the process including introducing a dual retention system into a cellulosic thin stock, subjecting the cellulosic thin stock to one or more shear stages, and then draining the cellulosic thin stock on a moving screen to form a dried sheet, wherein the dual retention system consists of a first polymeric retention aid and a second polymeric retention aid, the first polymeric retention aid is a water-soluble cationic polymer exhibiting an intrinsic viscosity of at least 6 dl/g, the second polymeric retention aid is a water-soluble cationic polymer exhibiting an intrinsic viscosity of from 4 to 9 dl/g, and the second polymeric retention aid has a greater cationic charge density than the first polymeric retention aid.

16 Claims, No Drawings

(56) References Cited

U.S. PATENT DOCUMENTS

| | | | | |
|---|---|---|---|---|
| 2013/0306257 | A1* | 11/2013 | Jehn-Rendu et al. | 162/10 |
| 2014/0124155 | A1* | 5/2014 | Jehn-Rendu | 162/168.3 |
| 2014/0318727 | A1* | 10/2014 | Solhage et al. | 162/168.3 |
| 2014/0367059 | A1* | 12/2014 | Gray et al. | 162/127 |
| 2015/0027651 | A1* | 1/2015 | Jehn-Rendu et al. | 162/164.6 |

FOREIGN PATENT DOCUMENTS

| | | | | |
|---|---|---|---|---|
| CN | 101351595 | A | 1/2009 | |
| CN | 101802304 | A | 8/2010 | |
| CN | 101999019 | A | 3/2011 | |
| EP | 0 102 760 | A2 | 3/1984 | |
| EP | 0 126 528 | A2 | 11/1984 | |
| EP | 0 150 933 | A2 | 8/1985 | |
| EP | 0 366 764 | | 5/1990 | |
| WO | WO 89/10447 | | 11/1989 | |
| WO | WO 98/29604 | | 7/1998 | |
| WO | WO 2005116336 | A1 * | 12/2005 | D21H 23/76 |
| WO | WO 2006090076 | A1 * | 8/2006 | D21H 21/18 |
| WO | WO 2009/136024 | A2 | 11/2009 | |
| WO | WO 2010/126712 | A1 | 11/2010 | |

* cited by examiner

MANUFACTURE OF PAPER AND PAPERBOARD

FIELD OF THE INVENTION

The present invention concerns a process for the manufacture of paper or paperboard. The process is particularly suitable for the manufacture of fine paper or multiply packaging paper. Such paper or paperboard may often contain filler.

BACKGROUND

It is well known to manufacture paper by a process that comprises flocculating a cellulosic thin stock by the addition of polymeric retention aid and then draining the flocculated suspension through a moving screen (often referred to as a machine wire) and then forming a wet sheet, which is then dried. Some polymers tend to generate rather coarse flocs and although retention and drainage may be good unfortunately the formation and the rate of drying the resulting sheet can be impaired. It is often difficult to obtain the optimum balance between retention, drainage, drying and formation by adding a single polymeric retention aid and it is therefore common practise to add two or frequently three or more separate retention aids in sequence.

EP-A-366764 describes a process of making paper by drainage of a cellulosic suspension through a screen for a cellulosic sheet in which an aqueous solution of a polymeric retention aid is included in the cellulosic suspension before drainage. The polymeric retention aid is formed from water-soluble ethylenically unsaturated monomer and has an intrinsic viscosity of at least 12 dl/g and high solubility. The process is said to improve the formation of the paper without deterioration of the retention. It is also indicated that further retention additives may be included before the aforementioned polymeric retention aid.

In the manufacture of high quality paper such as fine paper or complex paper such as multiply packaging it is always essential that high retention of fibre and filler is achieved. As the industry strives to greater productivity paper products, such as fine paper or multiply packaging, are often now manufactured on very high speed paper machines, such as Gap Formers, and/or employing double wire dewatering processes. Although productivity is improved there is a greater tendency to create and introduce higher levels of fine materials. This in turn causes a significant reduction in retention performance.

BRIEF SUMMARY OF THE INVENTION

The objective of the present invention is to improve the retention of fines materials in paper and paperboard making processes, especially on high shear paper machine conditions.

DETAILED DESCRIPTION OF THE INVENTION

According to the present invention we provide a process of manufacturing paper and paperboard employing two polymeric retention aids. The two polymeric retention aids should be added to the low consistency suspension, often referred to as the thin stock. The first polymeric retention aid is a water-soluble cationic polymer exhibiting an intrinsic viscosity of at least 6 dl/g.

The second polymeric retention aid is a water-soluble cationic polymer exhibiting an intrinsic viscosity of between 4 and 9 dl/g. Furthermore, the cationic charge density of the second polymeric retention aid must be higher than the cationic charge density of the first polymeric retention aid.

The first and second polymeric retention aids desirably may be prepared using a water-soluble ethylenically unsaturated monomer or blend of water-soluble ethylenically unsaturated monomers in which at least one of the monomers is cationic. Where the polymers are formed from more than one monomer the other monomers may be either cationic or non-ionic or a mixture, although it may be desirable for said monomers to include one or more anionic monomers resulting in an amphoteric polymer, provided that the overall charge is cationic. Nevertheless it is preferred that the two polymeric retention aids are formed entirely from cationic monomer or a mixture of monomers containing at least one cationic monomer and at least one non-ionic monomer.

The cationic monomers include dialkylamino alkyl(meth) acrylates, dialkylamino alkyl(meth)acrylamides, including acid addition and quaternary ammonium salts thereof, diallyl dimethyl ammonium chloride. Preferred cationic monomers include the methyl chloride quaternary ammonium salts of dimethylamino ethyl acrylate and dimethyl aminoethyl methacrylate. Suitable non-ionic monomers include unsaturated nonionic monomers, for instance acrylamide, methacrylamide, hydroxyethyl acrylate, N-vinylpyrrolidone.

Preferred first polymeric retention aids are also cationic polyacrylamides comprising acrylamide and at least one water-soluble cationic ethylenically unsaturated monomer, preferably quaternary ammonium salts of dialkyl amino alkyl (meth)-acrylates or N-substituted-acrylamides, especially the methyl chloride quaternary ammonium salts of dimethylamino ethyl acrylate. A particularly preferred polymer includes the copolymer of acrylamide with the methyl chloride quaternary ammonium salts of dimethylamino ethyl acrylate.

The first polymeric retention aid preferably contains at least 5 mol % cationic monomer units and up to 60 mol % cationic monomer units, more preferably between 5 and 40 mol % cationic monomer units, especially between 5 and 20 mol % with the remainder made up from ethylenically unsaturated non-ionic monomers. Especially preferred first polymeric retention aids include the copolymer of acrylamide with the methyl chloride quaternary ammonium salts of dimethylamino ethyl acrylate with the aforementioned ratios of monomers.

Preferably the first polymeric retention aid exhibits an intrinsic viscosity of at least 7 or 7.5 dl/g but more preferably at least 8 or 8.5 or even at least 9 dl/g, often at least 10 dl/g and especially at least 12 dl/g and particularly at least 14 or 15 dl/g. There is no maximum molecular weight necessary for the first polymeric retention aid and so there is no particular upper value of intrinsic viscosity. In fact the intrinsic viscosity of the first polymeric retention aid may even be as high as 30 dl/g or higher. Generally though the first polymeric retention aid often has an intrinsic viscosity of up to 25 dl/g, for instance up to 20 dl/g.

The second polymeric retention aid must have a higher cationicity than the first polymeric retention aid. It is preferred that the second polymeric retention aid contains at least 10 mol % cationic monomer units, the remainder formed from non-ionic ethylenically unsaturated monomer units. Desirably the second polymeric retention aid will contain between 10 and 90 mol % cationic monomer units, more preferably having cationic monomer units within the range of between 20 and 70 or 80 mol %, especially between 30 and 50 mol %, with the remainder made up from non-ionic ethylenically unsaturated monomer units.

Preferred second polymeric retention aids are cationic polyacrylamides comprising acrylamide and at least one water-soluble cationic ethylenically unsaturated monomer, preferably quaternary ammonium salts of dialkyl amino alkyl (meth)-acrylates or N-substituted-acrylamides, especially the methyl chloride quaternary ammonium salts of dimethylamino ethyl acrylate. Particularly preferred second polymeric retention aids include copolymers of acrylamide with dimethyl amino ethyl acrylate quaternised with methyl chloride. Such copolymers mentioned in this paragraph are especially preferred with the respective monomer ratios referred to in the previous paragraph.

Preferably the second polymeric retention aid exhibits an intrinsic viscosity of between 5 and 9 dl/g and more preferably between 6 and 8 dl/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers is measured using a Number 1 suspended level viscometer at 25° C. in 1M buffered salt solution. Intrinsic viscosity values stated are determined according to this method unless otherwise stated.

Desirably the polymers of either or both of the first and/or second polymeric retention aids may be provided as reverse-phase emulsions prepared by reverse phase emulsion polymerisation, optionally followed by dehydration under reduced pressure and temperature and often referred to as azeotropic dehydration to form a dispersion of polymer particles in oil. Alternatively the polymer may be provided in the form of beads and prepared by reverse phase suspension polymerisation, or prepared as a powder by aqueous solution polymerisation followed by comminution, drying and then grinding. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

Generally it is preferred that both the first and the second polymeric retention aids are added into the paper or paperboard making process in the form of aqueous solutions or as a combined mixture of aqueous solutions. Typically aqueous solutions of the two polymeric retention aids may be achieved by individually dissolving the respective polymers into water. This may for instance be achieved in a suitable polymer solution make up device. Such equipment is described in the prior art and for instance commercialised by BASF under the trademark Jet Wet™.

Generally paper and paperboard tends to be produced by a continuous process. Normally the starting point is a high-consistency pulp, often referred to as the thick stock, with a density, for instance, in the range from 3% to 6% by weight. The high-consistency pulp is suitably diluted to form a low consistency stock, often referred to as a thin stock, and typically having a density of not more than 20 g/l. The density may be as low as 0.5 g/l or below but is often in the range of between 1 and 6 g/l.

In the process of the present invention the first and second polymeric retention aids should be the only retention aids necessary. Thus the paper and paperboard making process is a dual retention system employing and the two polymeric retention aids are the sole retention additives. The two polymeric retention aids may be added to the thin stock stream of the paper making process at any suitable dosing point. For instance one or both of polymeric retention aids may be added to the thin stock before the last point of high shear, which in many papermaking processes will tend to be the centriscreen which is sometimes known as the pressure screen. Alternatively one or both of the polymeric retention aids may be added to the thin stock after the last point of high shear or centriscreen. Suitably both polymeric retention aids will be added to the thin stock before the headbox. In addition one or both of the two polymeric retention aids make each be added to the thin stock by splitting the dosing of the respective polymeric retention aid(s) into two or more separate dosing points.

One particularly preferred process employs the dosing of the first polymeric retention aid into the thin stock before the last point of high shear or centriscreen and then dosing of the second polymeric retention aid into the thin stock after the last point of high shear or centriscreen.

In an alternative particularly preferred process both the first and second polymeric retention aids are dosed into the thin stock after the last point of high shear or centriscreen. In this case the two polymeric retention aids may be added separately, either sequentially or ostensibly at the same dosing point in the thin stock stream i.e. simultaneously. The second polymeric retention aid may be dosed before the first polymeric retention aid but it is preferred that the first polymeric retention aid is added first with the second polymeric retention aid added subsequently. Nevertheless it is especially preferred that the first and second polymeric retention aids are combined together and dosed into the thin stock after the last point of high shear or centriscreen. This may be achieved by feeding the second polymeric retention aid into the feed line conveying the first polymeric retention aid. Alternatively the first polymeric retention aid may be introduced into the flow line of the second polymeric retention aid.

In forming the combination or mixture of the first and second polymeric retention aids it may be desirable to use a suitable mixing device. This may for instance be an in-line static mixer or alternatively it may be desirable to use a dynamic mixer.

All of these particularly preferred embodiments of the invention provide especially useful results when the first and second polymeric retention aids are both cationic polyacrylamides as defined previously.

The process of the present invention has been found to provide improvements in the fines material retention. The process also provides improvements in retention and in particular in the retention of filler.

The first polymeric retention aid may be added to the thin stock at a dose of at least 20 ppm (grams per tonne) based on dry weight of polymer on the dry weight of thin stock suspension. Desirably the dose of first polymeric retention aid will often be at least 50 ppm. The dose may be as much as 1000 ppm but usually may tend to be below 600 ppm. Preferably the dose of first polymeric retention aid will be between 100 and 400 ppm, such as between 150 and 300 ppm.

The second polymeric retention aid may be included in the thin stock at a dose of at least 50 ppm (grams per tonne) based on dry weight of polymer and dry weight of thin stock suspension. Suitably the second polymeric retention aid may have a dose of at least 100 ppm and the dose may be as much as 1500 ppm but frequently will be below 1000 ppm and normally below 800 ppm. A preferred dose of second polymeric retention aid will tend to be between 150 and 600 ppm, such as between 200 and 500 ppm.

The process is particularly suitable for the manufacture of fine paper or multiply packaging paper which often contains filler. Suitable paper manufactured by the process includes light weight coated paper (LWC) and super calendared paper (SC-paper).

Typically the thin stock may be derived from a mechanical pulp. By mechanical pulp we mean any wood pulp manufactured wholly or in part by a mechanical process, including stone ground wood (SGW), pressurised ground wood (PGW), thermomechanical pulp (TMP), chemithermomechanical pulp (CTMP) or bleached chemithermomechanical pulp (BCTMP). Mechanical paper grades contain different amounts of mechanical pulp, which is usually included in order to provide the desired optical and mechanical properties. In some cases the pulp used in making the filled paper may be formed of entirely of one or more of the aforementioned mechanical pulps. In addition to mechanical pulps other pulps are often included in the cellulosic suspension. Typically the other pulps may form at least 10% by weight of the total fibre content. These other pulps the included in the paper recipe include deinked pulp and sulphate pulp (often referred to as kraft pulp).

The thin stock suspension may be derived from a recycled pulp. For instance the thin stock may be derived from entirely recycled fibre. In other cases it may be desirable for the thin stock to be derived from between 10 and 90% by weight of recycled fibre.

In some cases it may be desirable that the fibre fraction of the stock contains deinked pulp, mechanical pulp and sulphate pulp. The mechanical pulp content may vary between 10 and 75%, preferably between 30 and 60% by weight of the total fibre content. The deinked pulp content (often referred to as DIP) may any between 0 and 90%, typically between 20 and 60% by weight of total fibre. The sulphate pulp content usually varies between 0 and 50%, preferably between 10 and 25% by weight of total fibre. The components when totaled should be 100%.

It may be desirable that the stock contains a mixture of long fibre and short fibre, for example between 30 and 70% by weight long fibre and between 70 and 30% by weight short fibre.

The thin stock suspension may contain other ingredients such as cationic starch and/or coagulants. Typically this cationic starch and/or coagulants may be present in the paper stock in for the addition of the retention/drainage system of the present invention. The cationic starch may be present in an amount between 0 and 5%, typically between 0.2 and 1% by weight of cellulosic fibre. The coagulant will usually be added in amounts of up to 1% by weight of the cellulosic fibre, typically between 0.2 and 0.5%.

Desirably the filler may be a traditionally used filler material. For instance the filler may be a clay such as kaolin, or the may be a calcium carbonate which may be ground calcium carbonate or preferably precipitated calcium carbonate (PCC). Another preferred filler material includes titanium dioxide. Examples of other filler materials also include synthetic polymeric fillers.

In general the cellulosic stock used in the present invention will preferably comprise significant quantities of filler, usually greater than 10% based on dry weight of the cellulosic stock. However, usually a cellulosic stock that contains substantial quantities of filler is more difficult to flocculate than cellulosic stocks used the may have paper grades that contain no or less filler. This is particularly true of fillers of very fine particle size, such as precipitated calcium carbonate, introduced to the paper stock as a separate additive or as sometimes is the case added with deinked pulp.

The present invention enables highly filled paper to be made from cellulosic stock containing high levels of filler and also containing mechanical fibre, such as SC paper or coated rotogravure paper, for instance LWC with good retention and formation and maintained allows for better control of the drainage of the stock on the machine wire. Typically the paper making stock will need to contain significant levels of filler in the thin stock, usually at least 25% or at least 30% by weight of dry suspension. Frequently the amount of filler in the headbox furnish before draining the suspension to form a sheet is up to 70% by weight of dry suspension, preferably between 50 and 65% of filler. Desirably the final sheet of paper will comprise up to 40% filler by weight. It should be noted that typical SC paper grades contain between 25 and 35% filler in the sheet.

Preferably the process is operated using an extremely fast draining paper machine, especially those paper machines that have extremely fast draining twin wire forming sections, in particular those machines referred to as Gapformers or Hybridformers. The invention is particularly suitable for the production of highly filled mechanical grade papers, such as SC paper on paper machines where an excess of initial drainage would otherwise result. The process enables retention, drainage and formation to be balanced in an optimised fashion typically on paper machines known as Gapformers and Hybridformers.

In the process of the present invention we find that in general the first pass total and filler retention may be adjusted to any suitable level depending upon the process and production needs. SC paper grades are usually produced at lower total and ash retention levels than other paper grades, such as fine paper, highly filled copy paper, paperboard or newsprint. Generally first pass total retention levels range from 30 to 60% by weight, typically from between 35 and 50%. Usually filler retention level may be in the range of from 15 to 45% by weight, typically between 20 and 35%.

The dosage in the following examples are expressed in weight % of dry polymer per ton of paper.

Polymer A: cationic water soluble polyacrylamide powder (solid content of 90%) formed from a monomer mixture containing 90 mol % acrylamide and 10 mol % methyl chloride quaternised dimethyl amino ethyl acrylate of intrinsic viscosity 13 dl/g. A solution at 0.1% is prepared for the retention and dewatering tests.

Polymer B: cationic water soluble polyacrylamide emulsion (solid content of 45%) formed from a monomer mixture containing 60 mol % acrylamide and 40 mol % methyl chloride quaternised dimethyl amino ethyl acrylate of intrinsic viscosity 7 dl/g. A solution at 0.1% is prepared for the retention and dewatering tests.

Polymer C: cationic water soluble polyacrylamide powder (solid content of 90%) formed from a monomer mixture containing 90 mol % acrylamide and 10 mol % methyl chloride quaternised dimethyl amino ethyl acrylate of intrinsic viscosity 9 dl/g.

Micro-particle: sodium activated bentonite prepared at 5% and then diluted at 0.5% for retention and dewatering tests.

The following examples illustrate the invention.

Example 1

A liner board furnish constituted of 100% of recycled fibers at a concentration of 0.73% and a pH of 6.86 is prepared for retention evaluation.

The retention and dewatering tests are done with a DFR 04 from the company BTG (60 mesh copper screen). Both of the retention and dewatering tests are conducted with a sample of 1000 ml thin stock furnish.

Chemical Addition Introduction Sequence:

at t=0 second, start of the stirrer at 1000 rpm at t=10 seconds, addition of the Polymer A solution (see table 1)

at t=30 seconds, reduction of the stirrer speed at 750 rpm and introduction of the Polymer B or the micro-particle (see table 1)

The retention is evaluated by the measurement of the total solids concentration found in a sample of 200 ml of white water (filtration of the white water made with an ash free filter paper type Whatmann 542). The First Pass Retention is then determined by the following ratio:

FPR(%)=([furnish concentration %]−[white water concentration])/[furnish concentration]

The dewatering time to collect 500 ml is recorded during the DFR 04 test.

TABLE 1

| Trials number | Polymer A | Polymer B | Micro-particle | FPR (%) | Dewatering time (seconds) |
|---|---|---|---|---|---|
| 1 | 270 ppm | 0 | 2000 ppm | 68.5 | 67 |
| 2 | 270 ppm | 240 ppm | 0 | 71.8 | 67 |

The substitution of the bentonite by the polymer B in trial number 2 can out-perform the inorganic bentonite micro-particle in retention and maintaining an equivalent dewatering time.

Example 2

A liner board furnish constituted of 50% long fibers and 50% short fibers at a concentration of 0.67% and a pH of 6.8 is prepared for retention and dewatering evaluations.

The retention and dewatering tests conditions are conducted following example 1 descriptions but using the polymers dosage of the table 2.

TABLE 2

| Trials number | Polymer A | Polymer B | Micro-particle | FPR (%) | Dewatering time (seconds) |
|---|---|---|---|---|---|
| 3 | 170 ppm | 0 | 2000 | 83.1 | 59 |
| 4 | 170 ppm | 200 ppm | 0 | 94.0 | 51 |

The substitution of the bentonite by the polymer B in trial number 4 can in this case out-perform the bentonite micro-particle in retention and in dewatering time.

Example 3

A liner board furnish constituted of 100% Old Corrugated Card at a concentration of 0.91% and a pH of 6.8 is prepared for retention evaluation.

The retention and dewatering tests conditions are conducted following example 1 descriptions but using the polymers dosage of the table 3.

TABLE 3

| Trials number | Polymer A | Polymer B | Micro-particle | FPR (%) | Dewatering time (seconds) |
|---|---|---|---|---|---|
| 5 | 200 ppm | 0 | 2000 | 76.8 | 77 |
| 6 | 200 ppm | 100 ppm | 0 | 84.2 | 69 |

The substitution of the bentonite by the polymer B in trial number 6 can again out-perform the bentonite micro-particle in retention and dewatering with an easier handling and costs advantage.

Example 4

On a full-scale papermaking process during a confidential trial fine paper is manufactured on a Gapformer paper machine. The stock is formed from a blend of thermo-mechanical pulp, chemical pulp, coated and uncoated broke. The paper machine is producing a light weight coated paper of basis weight 48 to 54 g/m2.

The retention system comprises originally in the dosage of 850 ppm Polymer C after the pressure screen. Such system could not maintain the paper mill target white water concentration lower of 2.9 g/l By adding a mixture of 600 ppm Polymer C and 270 ppm Polymer B (the polymers are combined in the form of aqueous solutions) and dosed immediately after the centriscreen, the white water concentration could be maintained at 2.6 g/l with an increased ashes retention of 2%.

The invention claimed is:

1. A process of making paper or paperboard, the process comprising:

introducing a dual retention system into a cellulosic thin stock, subjecting the cellulosic thin stock to one or more shear stages, and then draining the cellulosic thin stock on a moving screen to form a dried sheet, wherein the dual retention system consists of a first polymeric retention aid and a second polymeric retention aid, the first polymeric retention aid is a water-soluble cationic polymer exhibiting an intrinsic viscosity of at least 6 dl/g, the second polymeric retention aid is a water-soluble cationic polymer exhibiting an intrinsic viscosity of from 6 to 8 dl/g, the second polymeric retention aid has a greater cationic charge density than the first polymeric retention aid, the second polymeric retention aid comprises from 30 to 50 mol % of cationic monomers and from 50 to 70 mol % of non-ionic ethylenically unsaturated monomer units.

2. The process according to claim 1, wherein:

the first polymeric retention aid and the second polymeric retention aid are either separately dosed into the cellulosic thin stock after a last point of high shear or centriscreen; or combined into a mixture, which is then dosed into the cellulosic thin stock after the last point of high shear or centriscreen.

3. The process according to claim 2, wherein the first and second retention aids are both cationic polyacrylamides.

4. The process according to claim 2, wherein the first polymeric retention aid is a copolymer comprising:

from 70 to 95 mol % of acrylamide, and from 5 to 30 mol % of methyl chloride quaternary ammonium salt of dimethyl amino ethyl acrylate.

5. The process according to claim 2, wherein the second polymeric retention aid is a copolymer comprising:

from 20 to 80 mol % of acrylamide, and from 20 to 80 mol % of methyl chloride quaternary ammonium salt of dimethylamino ethyl acrylate.

6. The process according to claim 2, wherein the cellulosic thin stock comprises from 10 to 40 weight % of filler.

7. The process according to claim 1, wherein the first and second retention aids are both cationic polyacrylamides.

8. The process according to claim 7, wherein the first polymeric retention aid is a copolymer comprising:

from 70 to 95 mol % of acrylamide, and from 5 to 30 mol % of methyl chloride quaternary ammonium salt of dimethyl amino ethyl acrylate.

9. The process according to claim 7, wherein the second polymeric retention aid is a copolymer comprising:

from 20 to 80 mol % of acrylamide, and from 20 to 80 mol % of methyl chloride quaternary ammonium salt of dimethylamino ethyl acrylate.

10. The process according to claim 7, wherein the cellulosic thin stock comprises from 10 to 40 weight % of filler.

11. The process according to claim 1, wherein the first polymeric retention aid is a copolymer comprising:

from 70 to 95 mol % of acrylamide, and from 5 to 30 mol % of methyl chloride quaternary ammonium salt of dimethyl amino ethyl acrylate.

12. The process according to claim 11, wherein the second polymeric retention aid is a copolymer comprising:

from 20 to 80 mol % of acrylamide, and from 20 to 80 mol % of methyl chloride quaternary ammonium salt of dimethylamino ethyl acrylate.

13. The process according to claim 11, wherein the cellulosic thin stock comprises from 10 to 40 weight % of filler.

14. The process according to claim 1, wherein the second polymeric retention aid is a copolymer comprising:

from 20 to 80 mol % of acrylamide, and from 20 to 80 mol % of methyl chloride quaternary ammonium salt of dimethylamino ethyl acrylate.

15. The process according to claim 14, wherein the cellulosic thin stock comprises from 10 to 40 weight % of filler.

16. The process according to claim 1, wherein the cellulosic thin stock comprises from 10 to 40 weight % of filler.

* * * * *